US006360796B1

(12) United States Patent
Oledal et al.

(10) Patent No.: US 6,360,796 B1
(45) Date of Patent: Mar. 26, 2002

(54) WOOD WORKING MACHINE

(75) Inventors: Jan Oledal, Frösön; Åke Svensson, Själevad, both of (SE)

(73) Assignee: HFD Half Pipe Debarker AB, Anaset (SE)

( * ) Notice: Subject to any disclaimer, the term of this patent is extended or adjusted under 35 U.S.C. 154(b) by 0 days.

(21) Appl. No.: 09/646,658

(22) PCT Filed: Mar. 17, 1999

(86) PCT No.: PCT/SE99/00412

§ 371 Date: Nov. 20, 2000

§ 102(e) Date: Nov. 20, 2000

(87) PCT Pub. No.: WO99/48657

PCT Pub. Date: Sep. 30, 1999

(30) Foreign Application Priority Data

Mar. 20, 1998 (SE) ..... 9800926-9

(51) Int. Cl.[7] ..... B27L 1/00
(52) U.S. Cl. ..... 144/208.9; 144/341
(58) Field of Search ..... 144/208.1, 208.4, 144/208.9, 341

(56) References Cited

U.S. PATENT DOCUMENTS

| | | | | |
|---|---|---|---|---|
| 4,180,109 A | | 12/1979 | Heikkinen | |
| 4,685,498 A | | 8/1987 | Nakajima et al. | |
| 4,691,750 A | * | 9/1987 | Nakajima | 144/341 |
| 5,063,981 A | | 11/1991 | Jonkka | |
| 5,630,453 A | | 5/1997 | Ishizawa | |
| 5,647,418 A | * | 7/1997 | Ishizawa | 144/208.1 |
| 5,699,843 A | * | 12/1997 | Gagné | 144/208.9 |
| 6,189,583 B1 | * | 2/2001 | Kokko et al. | 144/341 |
| 6,213,178 B1 | * | 4/2001 | Jonkka et al. | 144/341 |

FOREIGN PATENT DOCUMENTS

| | | |
|---|---|---|
| SE | 89542 | 6/1937 |
| SE | 144422 | 12/1953 |

OTHER PUBLICATIONS

Derwent's abstract, No K–3693 E/31, week K31, Abstract of SU, 870142 (Forest Power Mech Inst), Oct. 7, 1981.
Derwent's abstract, No L–8014 B/51, week L51, Abstract of SE, 655528 (Forest Power Mechn Inst), Apr. 8, 1979.

* cited by examiner

*Primary Examiner*—W. Donald Bray
(74) *Attorney, Agent, or Firm*—Ware, Fressola, Van der Sluys & Adolphson LLP

(57) ABSTRACT

A wood working machine for wood like pulp wood, saw timber or similar elongated wood parts comprises a trough designed like a tunnel. The trough has a feeding in end and a feeding out end for the wood. Rotors, each provided with helical threads on its jacket surface, are arranged in the trough for the purpose of at least partially debarking the wood. The machine performs a method where the wood during the working is taken by the rotors (6) from a portion of the trough (2) on a first level to a side-displaced portion of the trough on a second, higher level. The wood falls down to the lower level whereby tumbling of the wood is brought about at the same time as a further working of the wood is conducted. The wood during the working is taken by the rotors from the feeding in end (3) of the trough (2) to its feeding out end (4).

2 Claims, 2 Drawing Sheets

WOOD WORKING MACHINE

BACKGROUND OF THE INVENTION

1. Technical Field

This invention relates to a method for working wood like pulp wood, sawtimber or similar elongated wood parts, a working machine being at hand, which comprises a trough designed like a tunnel, which trough has a feeding in end and a feeding out end for the wood and in which are arranged a plurality of rotors, provided with means on its jacket surface, the purpose of which is to debark at least partially of the wood.

The invention also relates to a working machine for carrying out the method.

2. Description of the Background Art

Machines are previously known which have been designed with longitudinal rotors with strong heels, intended to work the bark of the wood. In order that the machine function satisfactorily, it has been designed so that the feeding in end of the trough has been placed essentially higher than its feeding out end. Due to that fact, the transport of the wood through the machine has been made on a downward slope. This fact regarding the position of the trough means partly that the wood has to be lifted to a high position at the feeding in end, partly to be lifted up a good distance at the feeding out end in order to be able to be smoothly fed into a following chipper, saw station or the like.

Another drawback with the known machine is that the mentioned rotor heels work the wood across the fiber direction, i.e. the grain, whereby wood damage and fiber losses become great.

SUMMARY OF THE INVENTION

The purpose with the present invention is to bring about an adjustable, easy working of the wood, which makes the treatment of wood, which is both hard to work as well as easy to work possible. Furthermore, the transport through the trough from its feeding in end to its feeding out end is preferably made on an upward slope, i.e. a longitudinal center line through the trough from the feeding in end to its feeding out end inclines upwards. Due to that fact, the feeding of the wood into the trough is made on a low level and the feeding out to a following working station, for instance a chipper, is made an a relatively high level.

BRIEF DESCRIPTION OF THE DRAWINGS

A preferred embodiment of the invention shall be described more closely below with reference to the accompanying drawings, where.

DETAILED DESCRIPTION OF THE INVENTION

Figure 1A:
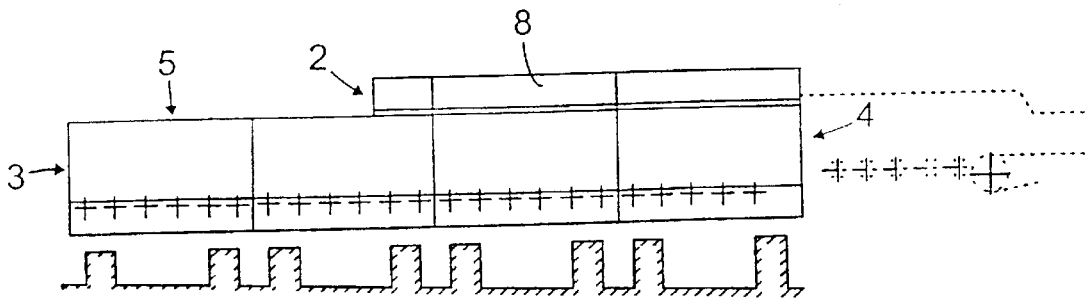
FIG. 1*a* shows the wood working machine from the side.
Figure 1B:
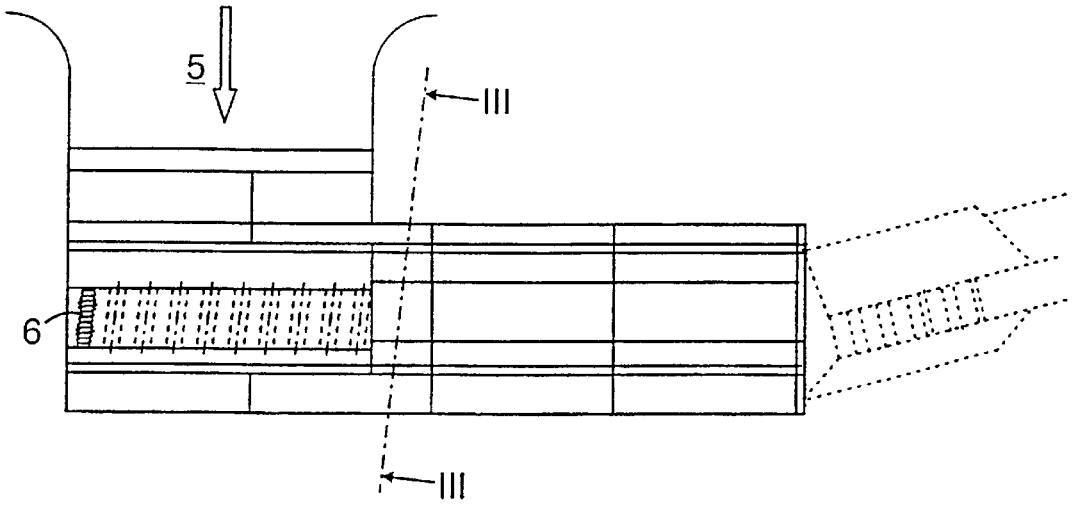
FIG. 1*b* shows the machine from above.
Figure 2:
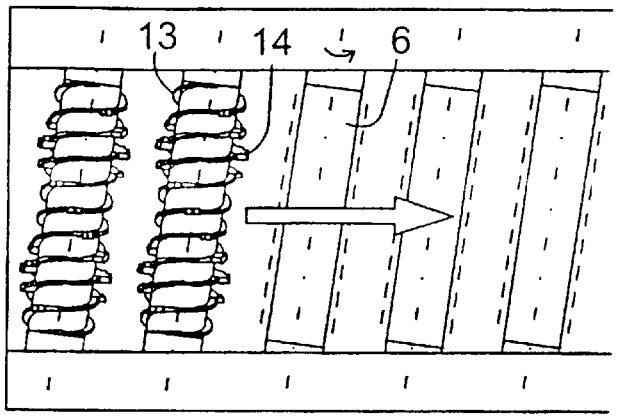
FIG. 2 shows a part of a longitudinal section, taken in parallel with the upperside of the rotors.
Figure 3:
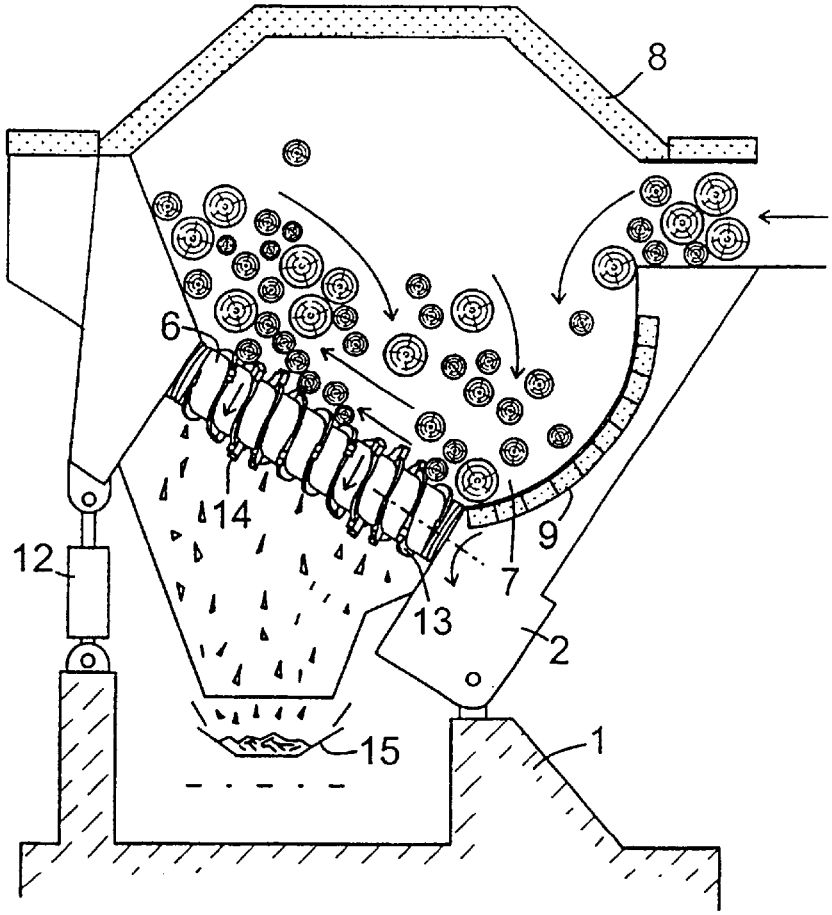
FIG. 3 shows a section through the machine, taken along the line III—III in FIG. 1*b*.

With reference to the drawings, therein is shown the wood working machine, which has a trough 2 in the form of a tunnel which is articulately suspended in a frame 1, the trough 2 having a feeding in end 3, and a feeding out end 4 for the wood. At the feeding in end 3 there is a feeding in opening 5 for the wood. The trough 2 has a great number of helical rotors 6 (see FIGS. 2, 3) at its lower part 7 and is provided with an openable cover 8 at its upper part in front of the feeding in opening 5 for reduction of dust and noise. Over the feeding in opening 5 itself there is no cover, whether fixed or openable. Due to that fact, the feeding of wood into the trough 2 is facilitated. A side portion of the trough 2 has a suitably designed wall 9.

One end of each of the helical rotors 6 is connected to the lower portion 10 of the wall 9 are inclined upwards in the direction from the lower portion 10 of the wall 9. This inclination of the helical rotors 6 are steplessly adjustable by the fact that the trough 2 can be steplessly pivoted about a suspension point 11, which can be a shaft, that is parallel with the longitudinal direction of the trough, by means of for instance a piston cylinder 12 or a screw jack. This means that the trough 2 can take different angle positions in relation to a transverse, horizontal line, drawn through the machine.

The helical rotors 6 are provided with screw threads 13 on its jacket surface. This fact plus the fact that the rotors 6 are obliquely positioned in relation to the transverse horizontal line through the machine make possible that the wood falls down between the threads 13 and are given a movement from below and upwards (see FIG. 3) at the same time as a debarking of the wood is made. At least certain parts of the screw threads 13 are provided with flails 14 or similar means, which are intended to damage the bark, whereby the debarking is made more effective.

According to a preferred embodiment, the helical rotors 6 are driven by one or more electric motors and have a length of about 2 m. The rotors 6 have a diameter of 600 mm and a pitch of about 800 mm. The rotors 6 are further arranged with an initial inclination so that they by means of the lifting cylinder can take an angle position in relation to the transverse horizontal line between 25° and 45°. with an initial inclination so that they by means of the lifting cylinder can take an angle position in relation to the transverse horizontal line between 25° and 45°.

For collection of bark and wastage is a conveyer 15 arranged under the wood working machine.

The wood working machine functions in that way that when wood in bundles or continuously is laid down into the trough 2 of the machine, it is influenced by the threads 13 of the helical rotors 6 so that it is lifted up and begins to rotate (tumble) in the trough 2 at the same time as it is driven upwards. Due to that fact, worked wood from its uppermost position will fall back to the bottom portion of the trough and once again begin to be worked. During the rotation of the rotors 6, the wood will not only be lifted upwards but of course be brought forwards towards the feeding out end 4 of the trough.

When continuously feeding wood in bundles into the trough 2, the tumbling will even out the wood to a continuous wood string which under a continuous tumbling is transported through the machine with a velocity which depends on the adjusted inclination of the rotors. Due to that fact, the degree of working can be adapted to the need, since the residence time of the wood in the machine is on the whole controlled by the inclination.

Due to special design of the rotors and the position of these ones, the great advantage is achieved that the debarking is made along the grain of the wood and not in its transverse direction across the grain. Due to that fact the debarking is easier on the wood.

What is claimed is:

1. A machine for working wood, comprising:

a trough which has a feeding in end and a feeding out end for the wood, the trough defining an upwardly inclined transporting direction for the wood whereby the feeding out end is at a higher level than the feeding in end;

a plurality of rotors arranged in the trough and having helical threads on a jacket surface thereof for at least partially debarking the wood, each of the plurality of rotors have a longitudinal axis forming an angle with a transverse horizontal line through the machine, the rotors are inclined backwards as viewed from the transporting direction of the wood; and a mechanism to steplessly pivot the trough about an axis parallel with the transporting direction of the wood, whereby the trough can take different angle positions relative to a transverse horizontal line through the machine and the angle between the longitudinal axes of the rotors and a transverse horizontal line through the machine can be steplessly changed.

2. A machine according to claim 1, further including an openable cover at an upper part of the trough for reduction of dust and noise.

* * * * *

UNITED STATES PATENT AND TRADEMARK OFFICE

CERTIFICATE OF CORRECTION

PATENT NO. : 6,360,796 B1 
DATED : March 26, 2002
INVENTOR(S) : Jan Oledal and Åke Svensson It is certified that error appears in the above-identified patent and that said Letters Patent is hereby corrected as shown below:

Column 2,
Lines 36-39, "with an initial inclination so that they by means of the lifting cylinder can take an angle position in relation to the transverse horizontal line between 25º and 45º." should be deleted.
After line 67, the following paragraph should be inserted:
-- The invention is of course not limited to the mentioned and shown embodiment but can be modified within the scope of the following claims. --

Signed and Sealed this

Sixteenth Day of July, 2002

*Attest:*

*Attesting Officer*

JAMES E. ROGAN
*Director of the United States Patent and Trademark Office*